US005797859A

United States Patent [19]

Prehodka

[11] Patent Number: 5,797,859

[45] Date of Patent: Aug. 25, 1998

[54] MASSAGER FOR PRODUCING ROTARY/ VIBRATORY MASSAGE MOTION, USING A SINGLE MOTOR

[75] Inventor: Barry V. Prehodka, Ridgefield, Conn.

[73] Assignee: Conair Corporation, Stamford, Conn.

[21] Appl. No.: 781,544

[22] Filed: Jan. 9, 1997

[51] Int. Cl.[6] ..... A61H 1/00; A61H 15/02

[52] U.S. Cl. ..... 601/22; 601/70; 601/46; 601/87; 601/113; 601/128

[58] Field of Search ..... 601/22, 27, 28, 601/31, 32, 46, 49, 50, 69, 70, 85, 87, 103, 104, 112, 113, 128, 131

[56] References Cited

U.S. PATENT DOCUMENTS

| | | | |
|---|---|---|---|
| 1,557,417 | 10/1925 | Cheney . | |
| 1,777,151 | 9/1930 | Rüttger-Pelli . | |
| 1,899,208 | 2/1933 | Murphy . | |
| 2,733,711 | 2/1956 | Gibson | 601/112 |
| 4,414,963 | 11/1983 | Kunz | 601/85 X |
| 4,873,966 | 10/1989 | Gitter | 601/22 X |
| 5,063,911 | 11/1991 | Teranishi | 601/45 |
| 5,215,078 | 6/1993 | Fulop . | |
| 5,356,369 | 10/1994 | Yamasaki et al. | 601/70 |

FOREIGN PATENT DOCUMENTS

| | | | |
|---|---|---|---|
| 3642338 | 5/1988 | Germany | 601/104 |
| 405285190 | 11/1993 | Japan | 601/22 |

*Primary Examiner*—Danton D. DeMille
*Attorney, Agent, or Firm*—Ohlandt, Greeley, Ruggiero, & Perle

[57] ABSTRACT

A massager for producing rotary and/or vibratory massage motion includes a base structure, a support plate with a contact surface and a mounting surface, and resilient mounts for coupling the support plate to the base structure. At least one rotator structure is associated with the contact surface of the support plate and includes massage members extending therefrom. A motor is attached to the mounting surface of the support plate and manifests a first direction rotary output and a counter direction rotary output. A gear structure couples the motor to the at least one rotator structure to cause rotary movement thereof, upon actuation of the motor. The massager includes an eccentric weight and a clutch system for driveably coupling the eccentric weight to the motor when the motor produces a first direction rotary output; and for decoupling the eccentric weight from the motor when the motor produces the counter-direction rotary output. In such manner, the single motor operates both the rotator structure and the eccentric weight and enables combined rotary/ vibratory motion to be achieved.

12 Claims, 6 Drawing Sheets

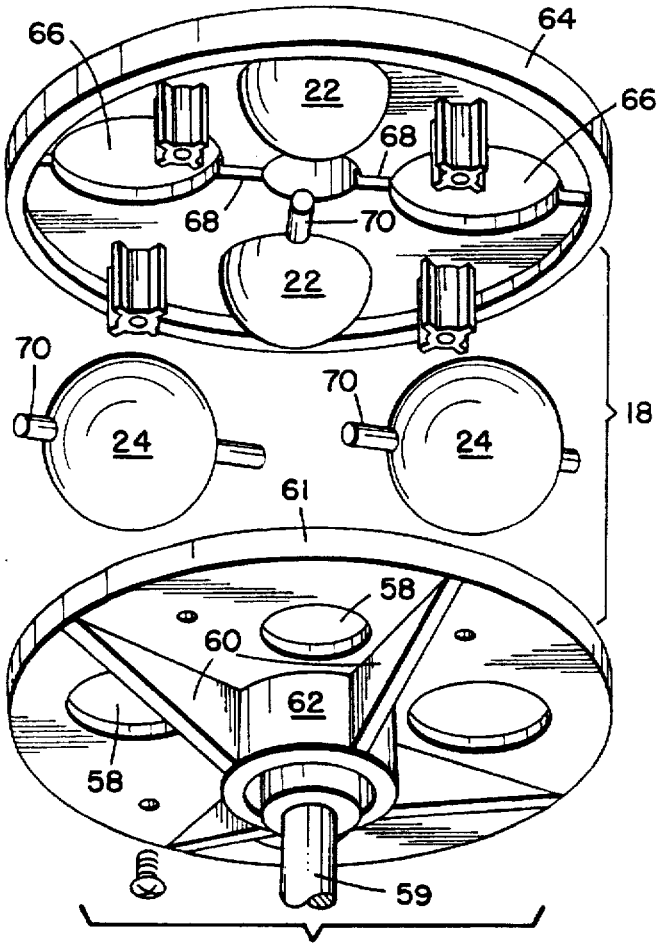
FIG. 6.
FIG. 8.
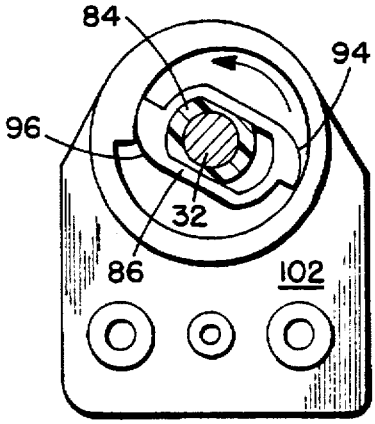
FIG. 9.
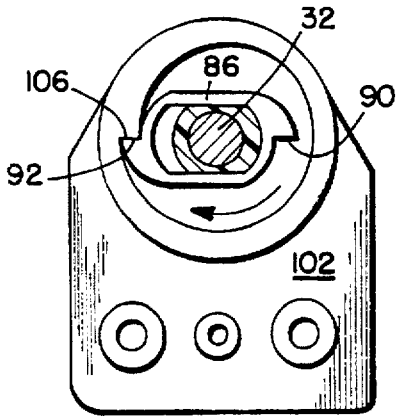
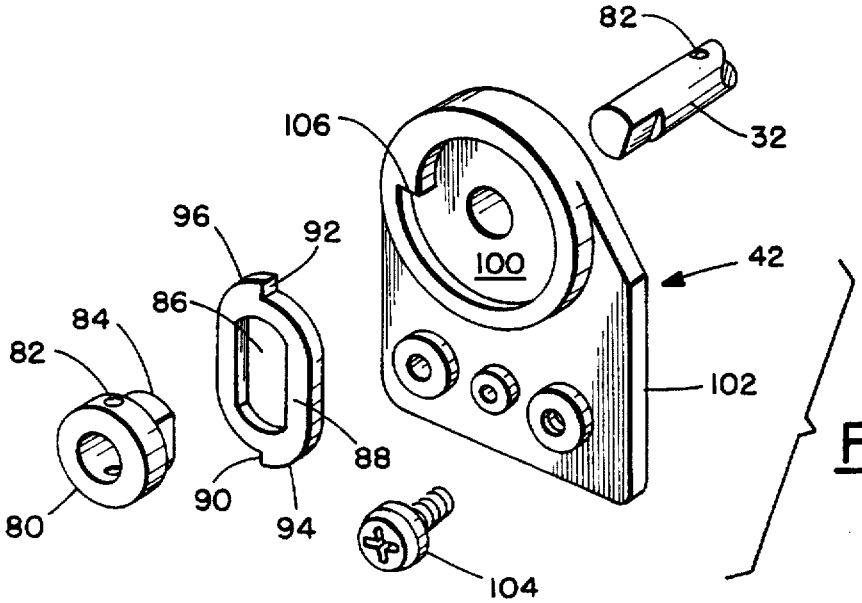
FIG. 7.

MASSAGER FOR PRODUCING ROTARY/ VIBRATORY MASSAGE MOTION, USING A SINGLE MOTOR

FIELD OF THE INVENTION

This invention relates to a massage apparatus for producing rotary and/or vibratory massage motions and, more particularly, to a massager which employs only a single motor for producing such massage motions.

BACKGROUND OF THE INVENTION

Massage units which employ movable ball-like members have been known in the prior art for many years. U.S. Pat. No. 1,557,417 to Cheney discloses a massage apparatus wherein multiple balls or cones are maintained on a turntable which is rotated by a worm gear/planar gear arrangement. When the balls are placed in contact with a portion of the body and an included motor is energized, the turntable rotates, causing the balls to also rotate, both with the turntable and within their individual housings. This action produces the massage action.

U.S. Pat. No. 1,777,151 to Ruttger-Pelli also discloses a turntable-like massager with plural, individually rotatable balls. Either the entire turntable can be caused to rotate or just the individual ball members themselves, to achieve a massage action.

U.S. Pat. No. 1,899,208 to Murphy describes a massage machine wherein plural ball members are mounted on axles which are, in turn, journaled onto a circular, rotatable plate. When a motor causes the plate to rotate, the balls also rotate on their respective axles and create a massage action.

Other forms of massage movement are also known in the prior art. For instance, many massagers employ a motor to drive an eccentric weight which creates a vibratory massage motion. U.S. Pat. No. 5,215,078 to Fulop describes a massager including an electric motor-driven eccentric cam which, in turn, drives a moving member in a reciprocating, translational in motion. A hand grip is mounted on opposed ends of the moving member and when the massager is held by two hands, the housing reciprocates in a translational motion relative to the hand grips and imparts a massage action to both the hands and the arms.

Accordingly, it is an object of this invention to provide a massager which includes provision for both rotary and vibratory massage actions.

It is another object of this invention to provide a massager for producing rotary and/or vibratory massage motion that can be produced economically.

It is yet another object of this invention to provide an improved massager which needs only a single motor to provide both rotary and/or vibratory massage motions.

SUMMARY OF THE INVENTION

A massager for producing rotary and/or vibratory massage motion includes a base structure, a support plate with a contact surface and a mounting surface, and resilient mounts for coupling the support plate to the base structure. At least one rotator structure is associated with the contact surface of the support plate and includes massage members extending therefrom. A motor is attached to the mounting surface of the support plate and manifests a first direction rotary output and a counter direction rotary output. A gear structure couples the motor to the at least one rotator structure to cause rotary movement thereof, upon actuation of the motor. The massager includes an eccentric weight and a clutch system for driveably coupling the eccentric weight to the motor when the motor produces a first direction rotary output; and for decoupling the eccentric weight from the motor when the motor produces the counter-direction rotary output. In such manner, the single motor operates both the rotator structure and the eccentric weight and enables combined rotary/vibratory massage motion to be achieved.

BRIEF DESCRIPTION OF THE DRAWINGS

FIG. 1(*a*) is a schematic showing of a rocker switch which can be foot operated to cause the massager of FIG. 1 to either produce combined rotary and vibratory massage or just rotary massage.

FIG. 6 is an exploded view of a massage rotator structure utilized with the invention.

FIG. 7 is an exploded view of an eccentric weight/clutch device employed with the invention.

FIGS. 8 and 9 illustrate the manner of clutching and declutching that occur, in dependence on the direction of rotation of a shaft output from an attached motor.

DETAILED DESCRIPTION OF THE INVENTION

Initially, it should understood that while the invention is to be hereafter described in the context of a foot massager, that the inventive concepts hereof are equally applicable to a massage apparatus which can be applied to any part of the body, wherein both rotary and vibratory massage are desired.

Figure 1:
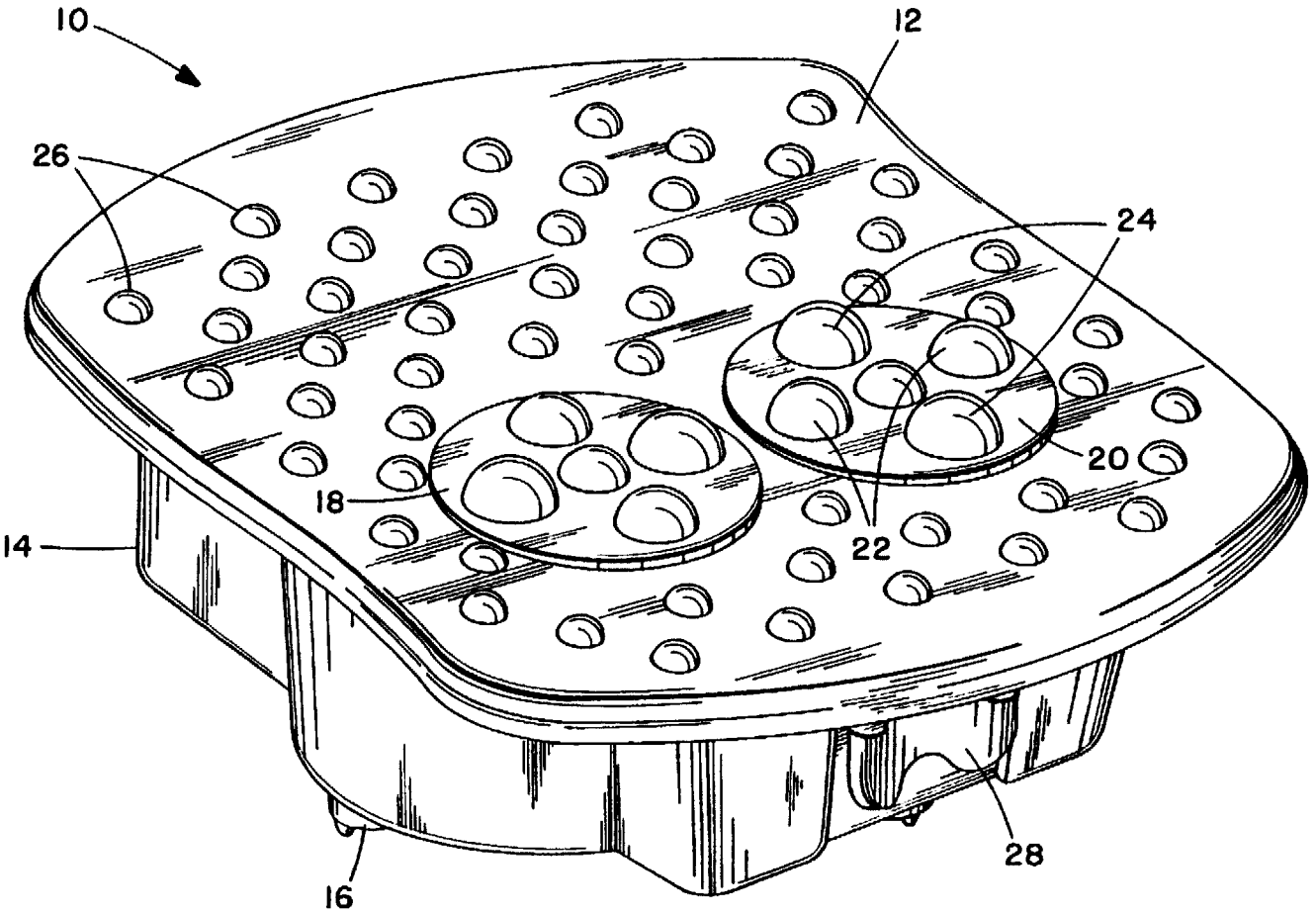
FIG. 1 is a perspective view of a massager incorporating the invention hereof.

Referring to FIG. 1, massager 10 includes a foot support plate 12 which is resiliently mounted onto a base structure 14 which, in turn, includes plural feet 16 that enable massager 10 to rest on a flat surface. Extending through support plate 12 are plural rotator structures 18 and 20, each rotator structure including two pairs of rotatable balls, 22 and 24. Balls 22 manifest larger diameters than balls 24. Each of balls 22 and 24 is adapted to independently rotate, but is constrained to rotation in one plane by a shaft which passes therethrough (not shown in FIG. 1).

Rotating structures 18 and 20 are rotatably mounted in support plate 12 and, when driven by a motor contained within massager 10, are adapted to counter rotate so as to provide a massage action by interaction of the balls with the soles of feet placed thereupon. The upper surface of support plate 12 is provided with plural fixed bumps 26 which enable a vibratory action to be imparted to the soles of the feet when massager 10 is controlled to provide a vibratory massage action.

Figure 1A:
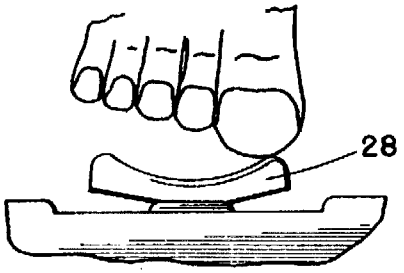

A rocker switch 28 may be foot operated (see FIG. 1*a*) to enable either only rotary operation of rotator structures 18 and 20 or to enable a vibratory action to be applied to rotatory structures 18 and 20 (while they rotate), in addition to causing the entire upper surface of support plate 12 to vibrate.

Figure 2:
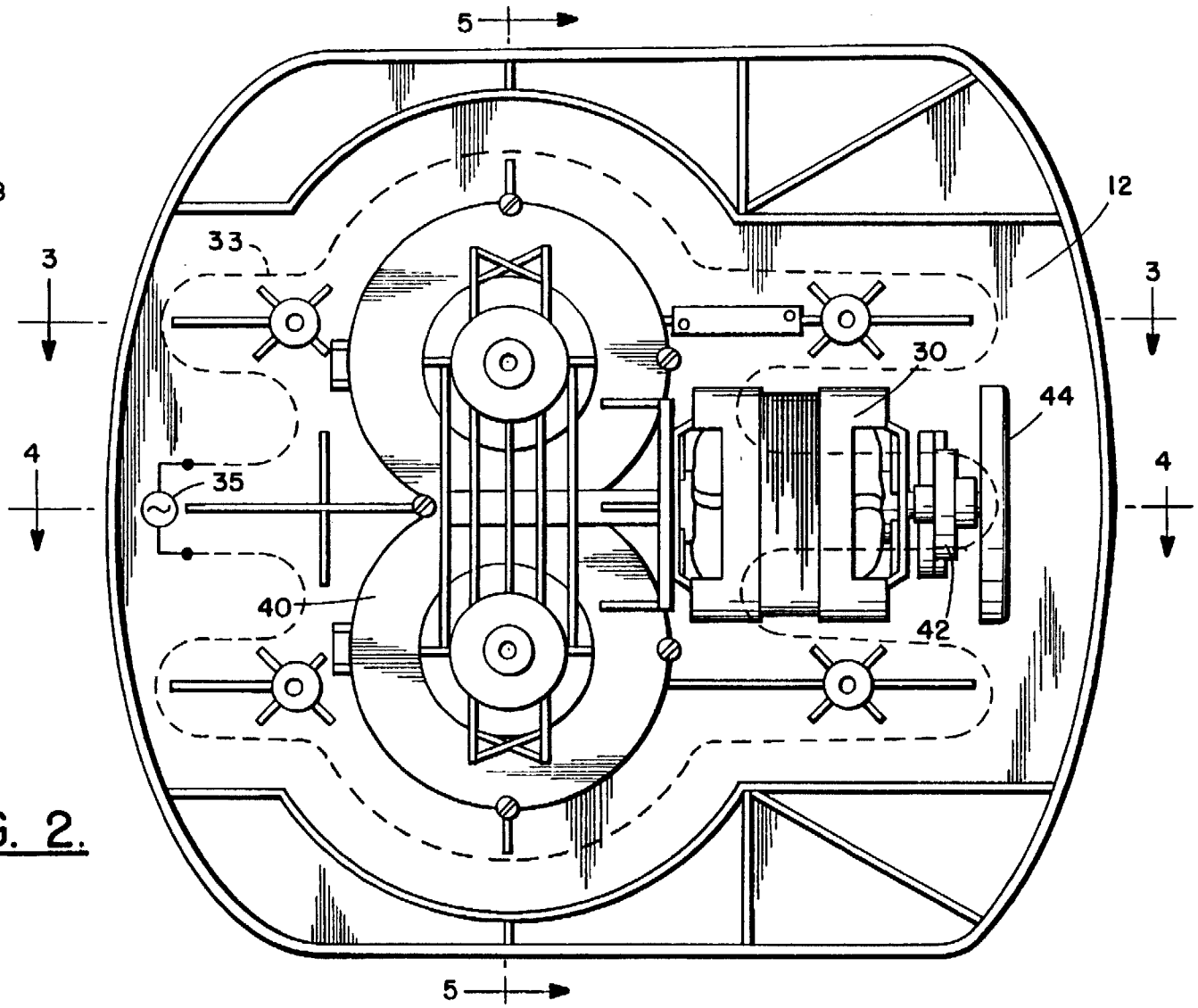
FIG. 2 is a bottom view of a support plate included in the massager of FIG. 1 after it has been removed from a base structure thereof, showing the apparatus mounted on the mounting side of the support plate.
Figure 2A:
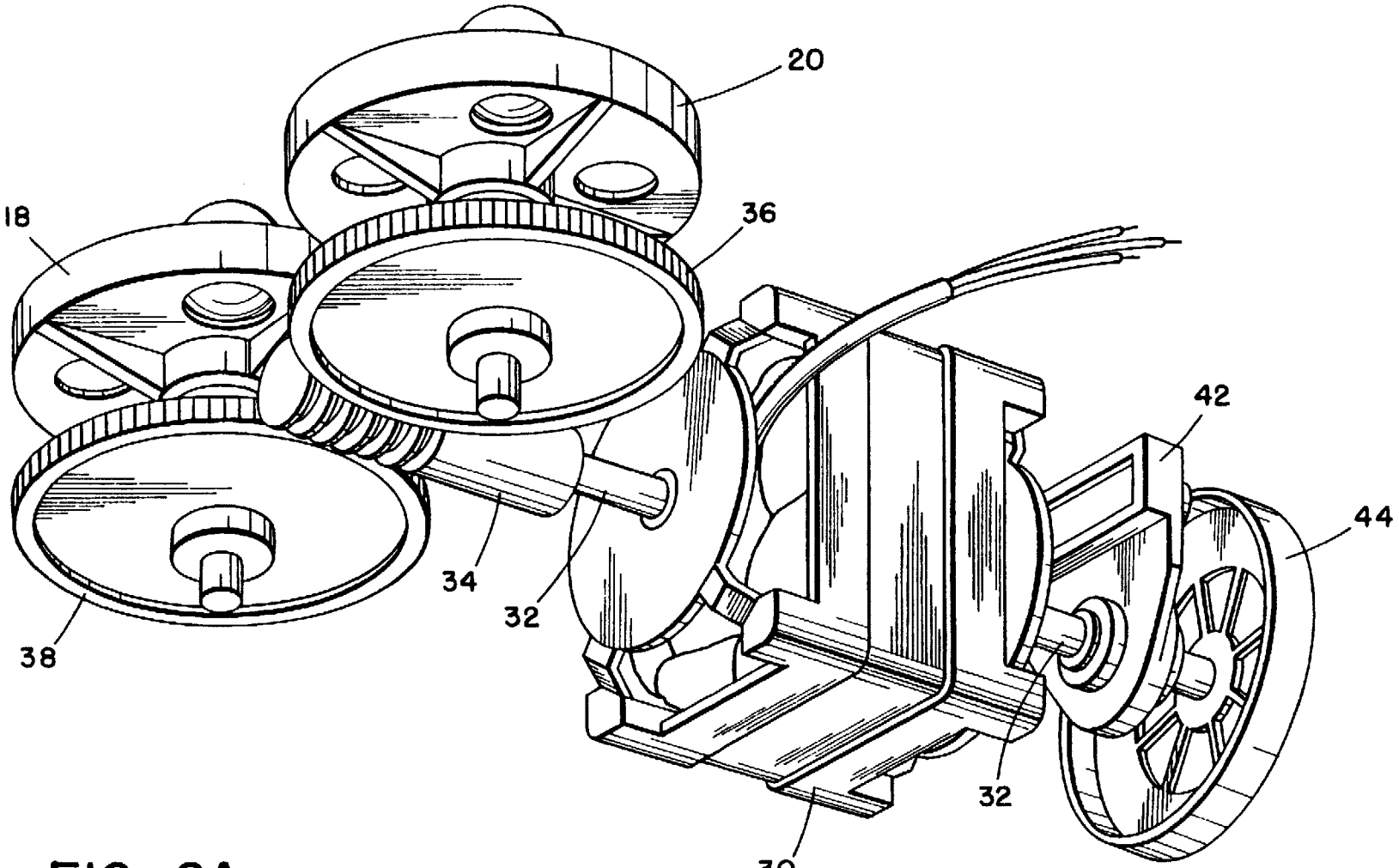
FIG. 2*a* is an isometric view of rotator structures, gearing, a motor and an eccentric weight which are attached to the underside of the support plate of FIG. 2.

Turning now to FIG. 2, base structure 14 has been removed from the massager 10, thus allowing the underside mounting surface of support plate 12 to be viewed. FIG. 2(*a*) will also be referred to in the discussion below as it illustrates, in a perspective manner, the apparatus coupled to the mounting surface of support plate 12. A motor 30 is attached to the mounting surface of support plate 12 and includes a shaft 32 which extends in opposite directions from motor 30. A worm gear 34 couples, through a pair of planar rotary gears 36 and 38, to rotary structures 18 and 20 (see FIG. 2*a*). In FIG. 2, a casing 40 covers worm gear 34, planar gears 36 and 38 and obscures them from the view. A heater wire 33 is affixed to the mounting surface of support plate 12 and when energized by connection to a power source (e.g., via switch 28), enables application of heat to the soles of feet placed on the upper surface of support plate 12.

The gear structure comprising gears 34, 36 and 38 enables rotary motion to be imparted to rotator structures 18 and 20 when motor 30 rotates in either a clockwise or a counter-clockwise direction. However, as will be hereafter understood, an eccentric weight 42, which is mounted for rotation on shaft 32, either freewheels on shaft 32 when it rotates in a first direction or is driven to rotate by shaft 32 when it moves in a counter-rotating direction. A fan 44 provides cooling action to motor 30 when shaft 32 rotates.

Figure 3:
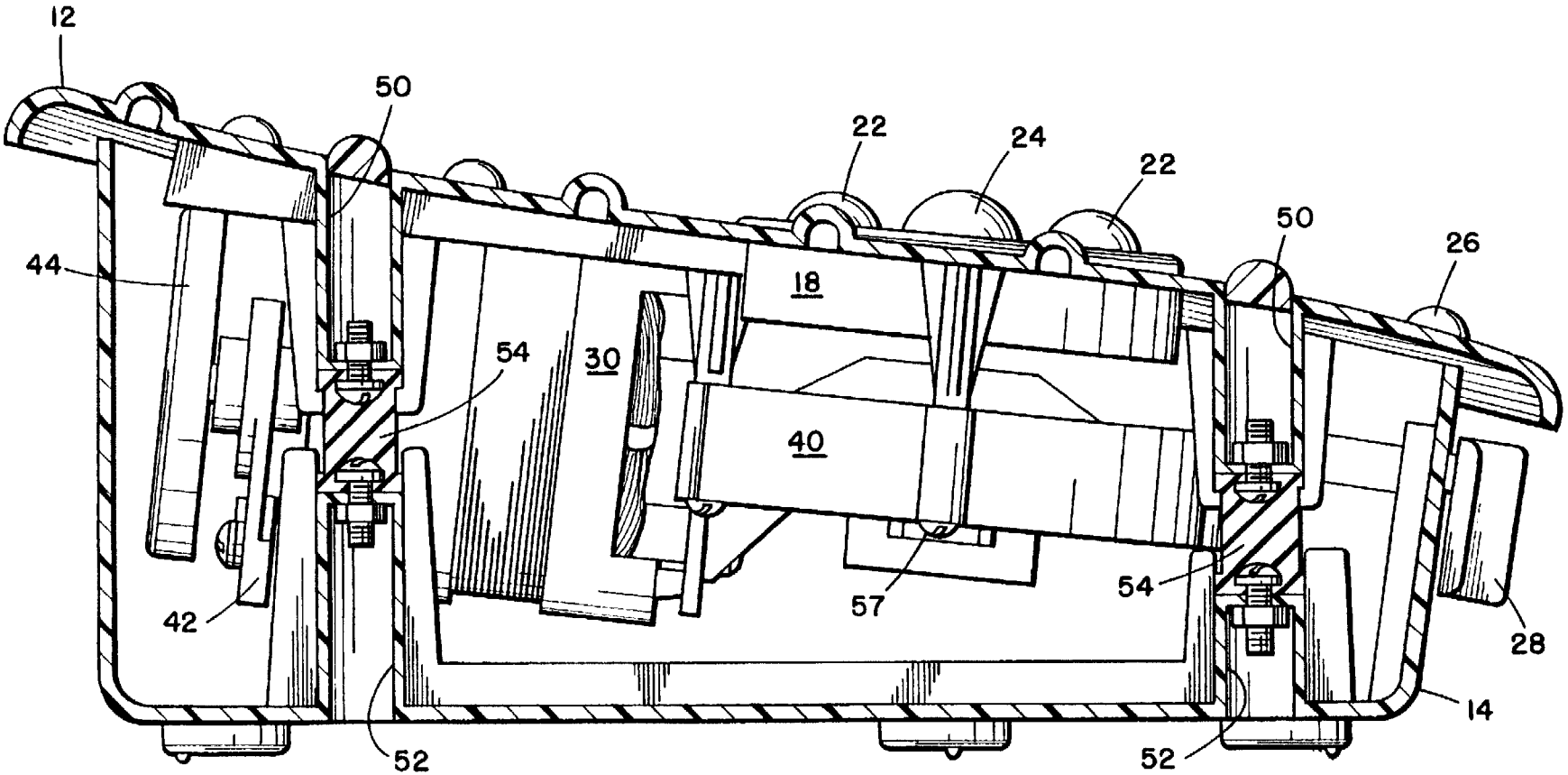
FIG. 3 is a sectional view of the support plate of FIG. 2, taken along line 3—3 (with base structure included).
Figure 4:
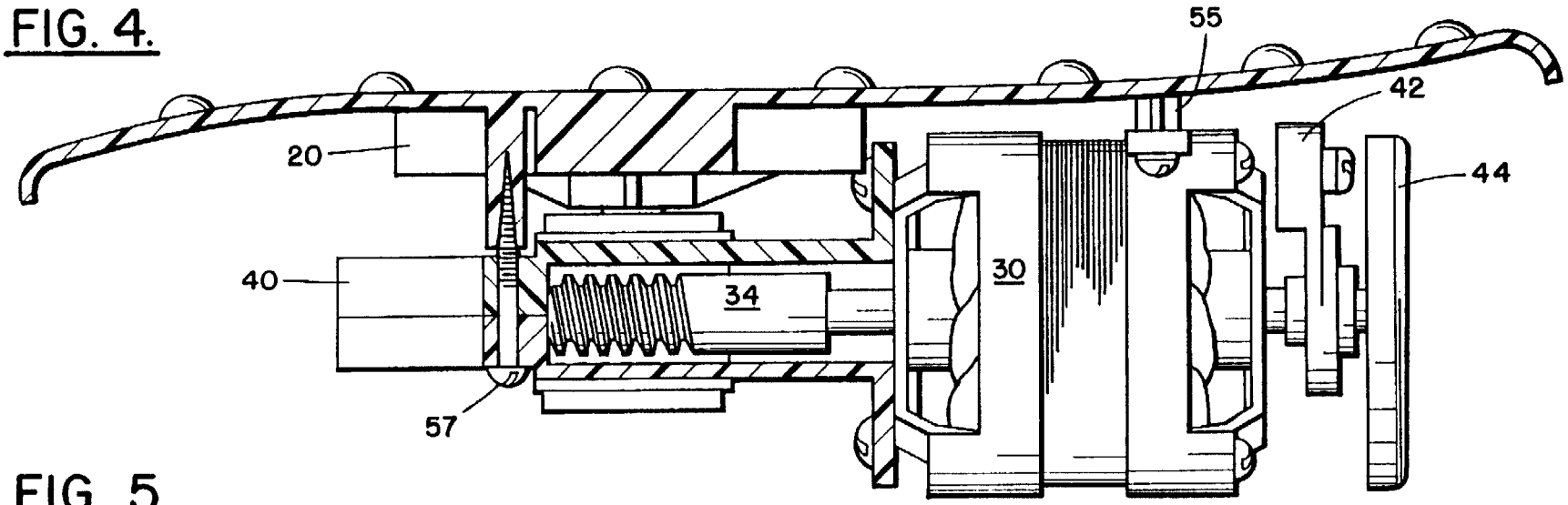
FIG. 4 is a sectional view the support plate of FIG. 2, taken along line 4—4, with base structure removed.
Figure 5:
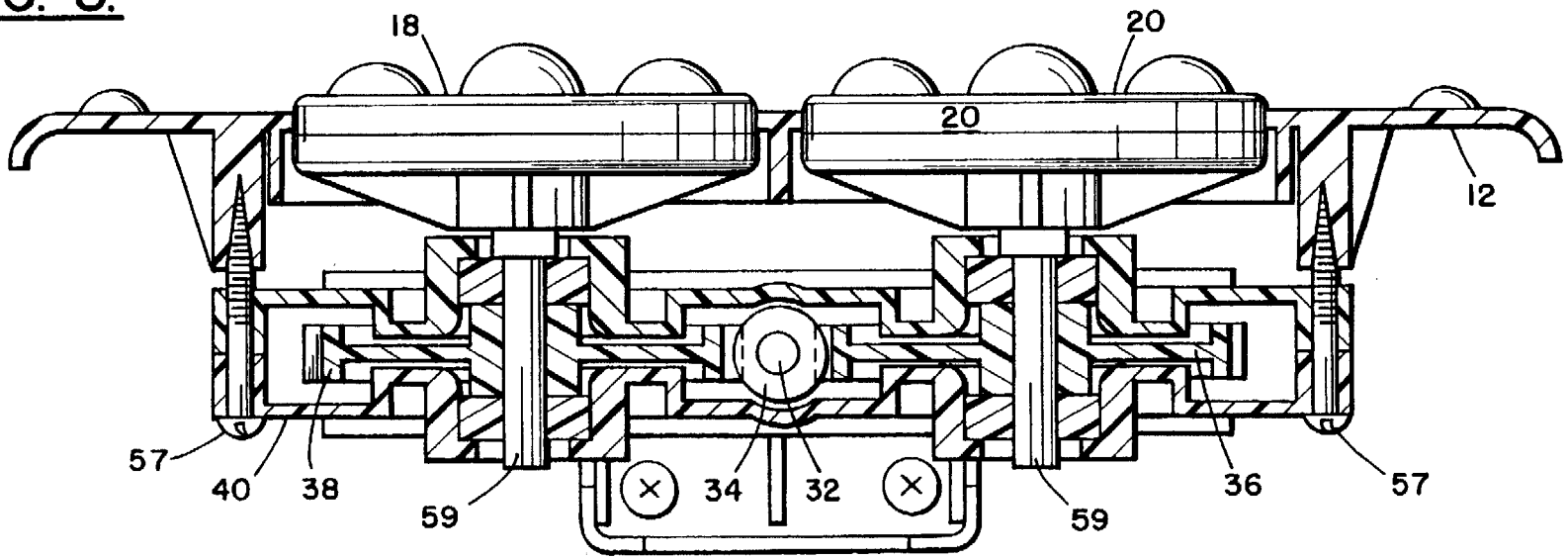
FIG. 5 is a sectional view of the support plate of FIG. 3, taken along line 5—5, with base structure removed.

Turning to FIGS. 3, 4 and 5, sectional views taken along lines 3—3, 4—4, and 5—5, respectively, will be described. In each of the Figures, the elements that are common to those shown in FIGS. 1, 1*a*, 2 and 2*a* are identically numbered. Note that motor 30 is fixedly attached to the mounting side of support plate 12. Further, support plate 12 includes four downwardly extending struts 50 which positionally mate with four upwardly extending struts 52 from base structure 14. Each pair of mating struts 50 and 52 is coupled, via screw fittings, by a resilient post 54, thereto. In such manner, support plate 12 and all of the members attached thereto are resiliently supported by posts 54 so as enable vibratory movement of support plate 12, independent of base structure 14.

FIG. 4 is a sectional view taken along line 4—4 in FIG. 2 and illustrates the mode of attachment of motor 30 to support 12 (via screw fittings 55). Further, rotator structure housing 40 is coupled to support plate 12 via screw fittings 57 (see also FIG. 5).

In FIG. 5, the mode of attachment of rotator structures 18 and 20 to gears 38, and 36 respectively, is illustrated. An axle 59 extends downwardly from each rotator structure and is rigidly coupled to an associated planar gear 38, 36. In such manner, when motor 30 rotates worm gear 34 in either direction, planar gears 36 and 38 are driven and cause axles 59 to counter-rotate rotating structures 18 and 20.

Turning to FIG. 6, an exploded view of a rotator structure (e.g. 18) is illustrated. Axle 59 extends into a lower cover 61 which includes plural openings 58 for receiving pairs of balls 22 and 24, respectively. Support struts 60 extend from the bottom of lower cover 56 to a cylindrical support 62 and provide structural rigidity for lower cover 61. Upper cover 64 is also provided with openings 66 to receive pairs of balls 22, 24. Slots 68 extend from each of openings 66 and serve to confine axles 70 which extend through pairs of balls 24, 22.

When lower cover 61 is brought together with upper cover 64, pairs of balls 22 and 24 are maintained in position thereby and enable shafts 70 to engage slots 68 and prevent rotational movement of ball members 22 and 24, except in planes orthogonal to their respective shafts 70. In such manner, when a rotator structure 18 is rotated, not only do ball members 22, 24 rotate with structure 18, but they also independently rotate about their respective shafts 70 and, due to the confining action thereof, create both a rolling and a frictional engagement with the soles of feet placed upon support plate 12.

To this point, the mechanism for providing rotary massage motion, through the action of rotator structures 18 and 20 has been described. Hereafter, a mechanism for providing either combined rotary and vibratory massage actions or just a rotary massage action will be described. FIG. 7 illustrates an exploded view of a clutch/eccentric weight structure 42. Shaft 32 extends therethrough and is pinned to a sleeve member 80 through corresponding pin openings 82. A slider bearing 84 extends from sleeve 80 and fits into a slot 86 within slider/clutch 88. A pair of engagement surfaces 90 and 92 are formed on the outer periphery of slider/clutch 88 and are positioned at terminal ends of camming surfaces 94 and 96, respectively.

Slider/clutch 88 fits within a recess 100 within eccentric weight 102. The weight of eccentric weight 102 can be varied by the insertion of screws 104 into receiving holes therein. Within recess 100 is a shoulder 106 which, in combination with engagement surfaces 90 and 92, provides a clutching action when shaft 32 rotates in a clockwise direction and, a declutching action when shaft 32 rotates in a counter-clockwise direction.

The operation of the clutching action will be better understood by reference to FIGS. 8 and 9. In FIG. 8, counter-clockwise rotation of shaft 32 is illustrated. Under such condition, slider/clutch 88 moves laterally along slider bearing 84 to enable engagement of one of camming surfaces 94 or 96 with the internal surface of 110 of recess 100. As a result, there is no transfer of motion between shaft 32 and eccentric weight 102, and eccentric weight 102 remains relatively motionless. By contrast (see FIG.9), when shaft 32 rotates in a clockwise direction, slider/clutch 86 extends laterally to a point where an engagement surface 90 or 92 makes contact with shoulder 106 and causes the rotary motion of shaft 32 to be imparted to eccentric weight 102. As a result, the eccentricity of weight 102 causes a vibratory motion to be imparted to motor 30 which, in turn, causes substantial vibratory motion to be imparted to support plate 12 and any foot positioned thereon.

As can thus be seen, through foot control of switch 28, the direction of rotation of motor 30 can be controlled to be in either a clockwise or counter-clockwise direction. The counter-clockwise action results in only rotary massage motion by rotator structures 18 and 20 due to the decoupling of weight 102 from shaft 32. In the case of clockwise rotation of motor 30, rotator structures 18 and 20 are rotated (but in the opposite direction) and a vibratory action is applied to support plate 12 because weight 102 is now driven by shaft 32. The attachment of the motor and gear arrangement to the mounting surface of support plate 12 and the mass they add to support plate 12, substantially enhance the vibratory massage action. Only a single motor is required to impart both of these actions, thereby resulting in a reduced cost device.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A massager for producing rotary and/or vibratory massage action comprising:

a base structure;

a support plate with a contact surface and a mounting surface;

means for resiliently mounting said support plate to said base structure;

at least one rotator structure associated with said contact surface and having massage members extending therefrom;

a motor attached to said mounting surface and manifesting a first rotary output and a counter rotary output;

gear means attached to said mounting surface, for coupling said motor to said at least one rotator structure to cause a rotary movement thereof upon actuation of said motor;

an eccentric weight; and clutch means for driveably coupling said eccentric weight to said motor when said motor produces said first rotary output and for decoupling said eccentric weight from said motor when said motor produces said counter rotary output.

2. The massager as recited in claim 1, wherein each of said massage members is mounted for independent rotary movement.

3. The massager as recited in claim 2, wherein said at least one rotator structure comprises:

a cylindrical structure having plural apertures in a planar major end surface;

plural spheres positioned within said cylindrical structure, each sphere extending through at least one of said plural apertures, each sphere mounted to rotate on a shaft; and support means for rotatably mounting each shaft within said cylindrical structure.

4. The massager as recited in claim 3, wherein said support means causes each said shaft to be positioned coincident with a radius of said cylindrical structure.

5. The massager as recited in claim 4, wherein said cylindrical structure extends though an aperture in said support plate so that each of said spheres extends above said support surface.

6. The massager as recited in claim 4, wherein some of said plural spheres exhibit a diameter different from others of said plural spheres so as to provide an enhanced massage action.

7. The massager as recited in claim 1, wherein both said eccentric weight and said clutch means are positioned on a shaft extending from said motor, said eccentric weight rotatably mounted on said shaft and having a shoulder, said clutch means further comprising:

a slider engaged to rotate with said shaft and mounted for movement transverse to a long axis of said shaft, said slider having an engagement surface which engages said shoulder when said shaft is rotated by said first rotary output of said motor.

8. The massager as recited in claim 7, wherein said slider includes a cam surface which moves over said shoulder in a non-engaging manner when said shaft is rotated by said counter rotary output of said motor.

9. The massager as recited in claim 1, further comprising:

a switch mounted on said base structure and positioned for actuation by a user's foot, said switch having one position which causes said motor to produce said first rotary output, and a second position which causes said motor to produce said counter rotary output.

10. The massager as recited in claim 8, further comprising:

a switch mounted on said base structure and positioned for actuation by a user's foot, said switch having one position which causes said motor to produce said first rotary output, and a second position which causes said motor to produce said counter rotary output.

11. The massager as recited in claim 1, further comprising:

heater means associated with said support plate for selectively applying heat to said support surface.

12. The massager as recited in claim 11, wherein said heater means comprises a heater wire affixed to said mounting surface of said support plate.

* * * * *